United States Patent [19]

Okada

[11] Patent Number: 4,492,379

[45] Date of Patent: Jan. 8, 1985

[54] REEL TYPE SLOT MACHINE

[75] Inventor: Kazuo Okada, Tokyo, Japan

[73] Assignee: Kabushiki Kaisha Universale, Tochigi, Japan

[21] Appl. No.: 451,240

[22] Filed: Dec. 20, 1982

[30] Foreign Application Priority Data

Dec. 22, 1981 [JP] Japan ..... 56-191405[U]

[51] Int. Cl.[3] ..... A63F 5/04

[52] U.S. Cl. ..... 273/143 R

[58] Field of Search ..... 273/138 R, 138 A, 141 R, 273/143 R, 139, 143 A, 143 B, 143 C, 143 D, 143 E; 194/DIG. 11; 235/1 B, 1 C, 103; 340/323 R

[56] References Cited

U.S. PATENT DOCUMENTS

| | | | |
|---|---|---|---|
| 4,095,795 | 6/1978 | Saxton et al. | 273/143 R |
| 4,099,722 | 7/1978 | Rodesch et al. | 273/143 R |
| 4,138,114 | 2/1979 | Andersen | 273/143 R |
| 4,200,291 | 4/1980 | Hooker | 273/143 R |
| 4,238,127 | 12/1980 | Lucero et al. | 273/143 R |
| 4,261,571 | 4/1981 | Ito | 273/143 R |
| 4,273,334 | 6/1981 | Schöne | 273/143 R |
| 4,299,388 | 11/1981 | Resch et al. | 273/143 R |

*Primary Examiner*—Richard C. Pinkham
*Assistant Examiner*—MaryAnn Stoll
*Attorney, Agent, or Firm*—Young & Thompson

[57] ABSTRACT

A slot machine has a micro-computer comprising a table memory for storing information as to symbol arrangements on reels rotatably arranged side by side, and a memory for storing information as to the numbers of coins or tokens to be paid out according to predetermined prize-winning combinations of symbols. Upon the reels being stopped, individually, the table memory is accessed with address signals corresponding to the stopped positions of the respective reels which are detected by counters associated therewith as to prize-winning combinations of symbols that have occurred in the prize-awarding rows in such a way that all of the symbols read out from the table memory are compared with a respective one of the predetermined symbols read out one after another.

2 Claims, 3 Drawing Figures

REEL TYPE SLOT MACHINE

BACKGROUND OF THE INVENTION

The present invention relates to slot machines and, in particular, to slot machines of the type in which a microcomputer determines occurrence patterns of combinations of different symbols visible through windows of a machine housing so as to pay out coins or tokens as prizes according to patterns of prize-winning combinations of symbols.

In slot machines, a plurality of reels, for instance three reels rotatably arranged side by side are caused to stop, individually, when stop buttons associated with the respective reels, are pushed or after a proper lapse of time predetermined by random timer means. Three symbols of each reel are visible through a window. The machine can award coins or tokens as prizes when predetermined prize-winning combinations of symbols occur in at least one of three transverse and two diagonal rows, five rows in total, which are prize-awarding rows. The number of prize coins or tokens to be paid out is according to the occurrence patterns of the combinations of symbols. However, the number of prize-awarding rows which are available is increased according to the number of coins or tokens inserted. For example, only the middle transverse row may be available for a single coin or token. Thus the chances of enjoying a prize-winning combination of symbols are improved in dependence on the number of coins or tokens inserted.

In conventional slot machines, the respective reels are provided with symbol detection brush members, three for every reel. This leads to an intricate construction of the machines and to failures of the machines owing to this intricate construction. Such slot machines are further designed in such a way that short circuits including the brush members associated with the respective reels determine occurrence patterns of the combinations of symbols and cause a circuit element to be active so as to pay out a given number of coins or tokens as prizes. Since, however, the pattern-determining and prize-paying-out device has a large number of relay devices, such a device is undesirable in view of high cost and low reliability.

OBJECTS OF THE INVENTION

It is therefore an object of the present invention to provide a slot machine simplified in construction.

It is another object of the present invention to provide a slot machine of relatively low production cost.

It is still another object of the present invention to provide a slot machine which enjoys trouble-free operation.

It is a further object of the present invention to provide a slot machine wherein symbols on reels in prize-awarding rows can be detected without the provision of contact members in contact with the reels.

It is still a further object of the present invention to provide a slot machine wherein prize-winning combinations of symbols and/or the number of coins to be paid out as prizes can be rearranged easily.

SUMMARY OF THE INVENTION

The above and other objects of the present invention are achieved by providing table memory means for storing information as to the arrangement of symbols on each reel, and memory means for storing information both as to predetermined prize-winning combinations of symbols and as to the numbers of coins or tokens to be paid out in accordance with the prize-winning combinations of symbols, thereby electrically determining the occurrence patterns of combinations of symbols in prize-awarding rows on the basis of the stopped positions of the respective reels, and then determining the number of coins to be paid out by referring to the information stored in the memory. Although, in general, three transverse rows, and two diagonal rows as required, are appropriated to prize-awarding rows, the number of practically available prize-awarding rows is changeable according to the number of coins or tokens put into the slot machine.

Detecting devices for detecting the stopped positions of the reels are disclosed in copending applications Ser. Nos. 330,831, filed Dec. 15, 1981, and 338,497, filed Jan. 11, 1982. In these earlier applications, the stopped position of each reel is detected in such a way that a counter integrates signals generated by optical marks associated with the respective symbols, said counter being adapted to reset its previous content to an initial value every complete revolution of the reel, or in such a way that a pulse counter or a micro processor counts pulse signals which are fed to pulse motors associated with the respective reels.

The present invention is useful with slot machines both of the type in which a plurality of reels are brought to a stop by operating stop switches respectively associated therewith, and of the type in which a plurality of reels are automatically brought to a stop after a proper lapse of time predetermined by random timer means, as is well known in this art.

BRIEF DESCRIPTION OF THE DRAWINGS

These and other features and advantages of the present invention will be described in more detail in the following, by way of examples, with reference to the accompanying drawings, in which.

DETAILED DESCRIPTION OF THE INVENTION

Figure 1:
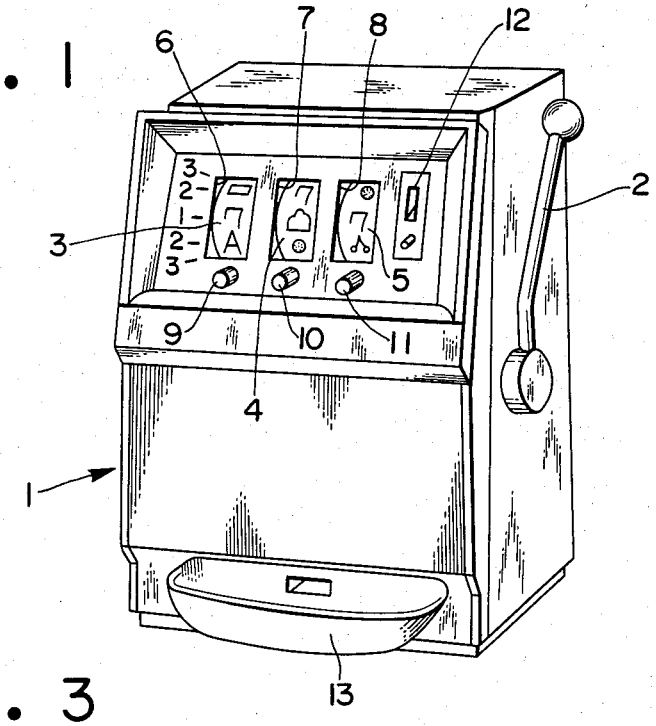
FIG. 1 is a perspective view showing a slot machine according to the invention.

Referring now to FIG. 1, there is shown a slot machine 1 wherein reels 3 to 5 are caused to rotate simultaneously by the pulling of a handle 2. On the outer surface of each reel is printed or otherwise provided an annular series of spaced symbols such as a lemon, a cherry, the legend SKILL.STOP, a figure seven or the like; and three symbols on every reel are visible through windows 6 to 8. When a combination of three SKILL.-STOP legends occurs in any one of prize-awarding rows, an extra or bonus game is awarded. In a bonus game, the respective reels automatically start to rotate relatively slowly, so that players can recognize the symbols on the reels easily during the rotation thereof. This allows the players to increase their probability of causing predetermined prize-winning combinations of symbols to appear. It is to be noted that the reels 3 to 5 can be brought to a stop upon touching with the finger the respective stop switches 9 to 11 associated therewith. Otherwise, the reels 3 to 5 may be automatically individually stopped after the proper lapse of time predetermined by random timer means.

With the insertion of coins or tokens through a coin or token slot 12, the slot machine automatically releases the handle 2 which was theretofore locked by means of a conventional magnet, allowing the players to play. If the number of coins inserted was one, the machine will be set to award prizes for an occurrence of any one of the predetermined prize-winning combinations of symbols in only the middle transverse prize-awarding row. A given number of prize coins are thereupon paid out into a coin saucer 13 in accordance with patterns of the predetermined prize-winning combinations of symbols. But if the number of coins inserted was two or three, the machine awards prizes for any of the predetermined prize-winning combinations of symbols in the three transverse prize-awarding rows or in the three transverse and two diagonal prize-awarding rows, respectively. The machine may also be so designed as to pay out prize coins in proportion to the number of coins inserted. Furthermore, it is attractive for players to provide the machine with two prize-awarding modes, in one of which the number of prize-awarding rows that are operative is changed in accordance with the number of coins inserted, and in the other of which, the number of prize coins to be paid out is proportional to the number of coins inserted. In this case, it is desirable to provide the machine with a switch for selecting one of the prize-awarding modes.

Figure 2:
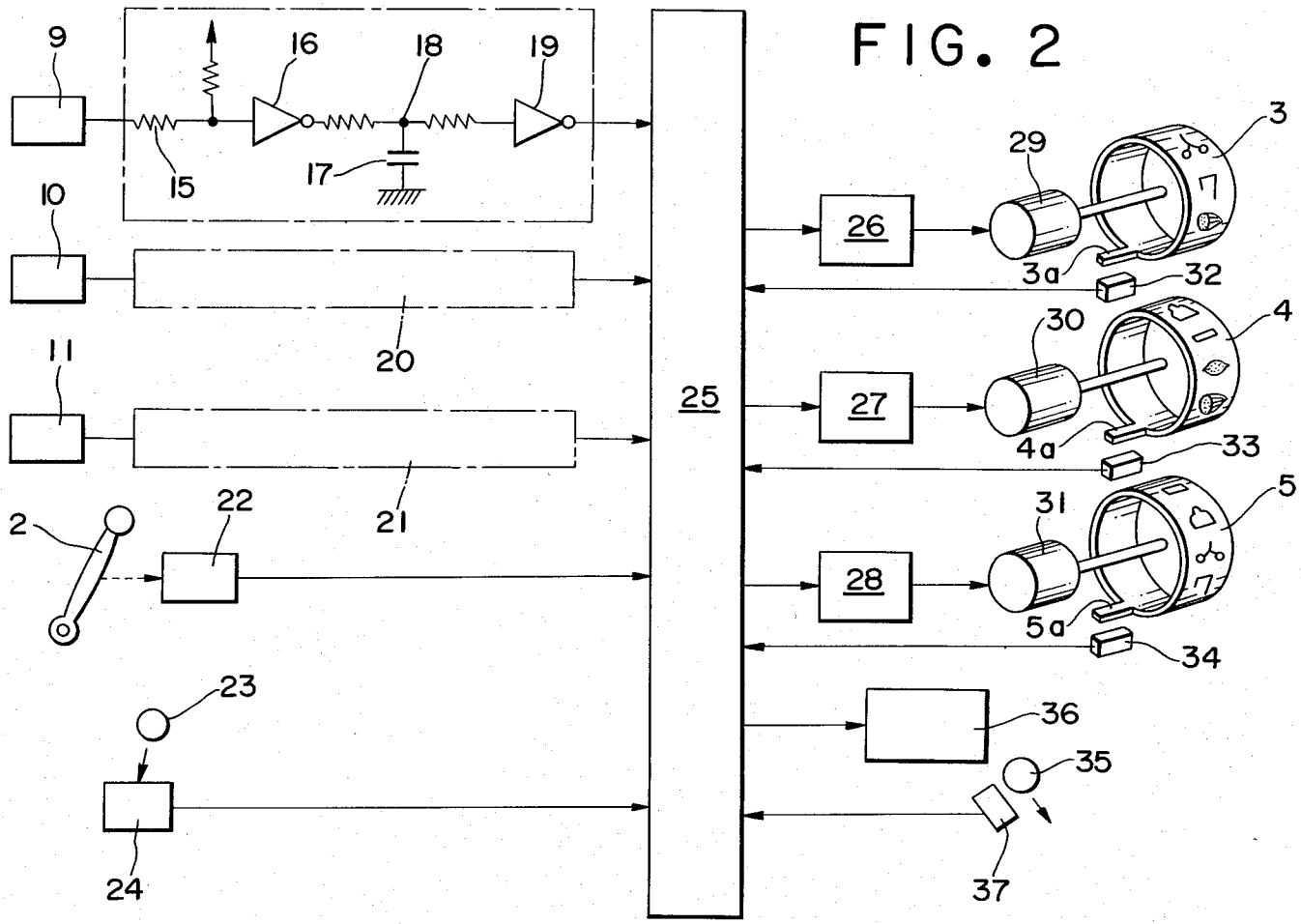
FIG. 2 is a block diagram showing an electric control circuit.

Referring to FIG. 2 showing the electrical diagram, the stop switch 9 is connected to an inverter 16 to which a high voltage is applied through a resistor 15. The inverter 16 at its output terminal is changed from "L38 (low) to "H38 (high) in output upon touching the stop switch 9 with a finger. At this time, a capacitor 17 is caused to start to charge until the voltage at a connection 18 reaches a predetermined voltage level. This predetermined voltage at the connection 18 causes an inverter 19 at its output terminal to change from "H38 to "L38 . In the same way, the stop switches 10 and 11 coact with respective checking circuits 20 and 21 associated therewith. There are further provided switches 22 and 24 which are so constructed as to turn on upon pulling the handle 2 and upon inserting a coin 23 into the coin slot 12, respectively. The start switch 22 may be mounted on the panel of the machine housing so as to be touched with the fingers instead of operating the handle 2.

A conventional micro computer 25 causes a solenoid to be energized, releasing the handle to be operable when the coin switch 24 is turned on, and then allows a game program to be carried out so as at first to supply pulse signals to motor control circuits 26 to 28 when the start switch 22 is turned on by the handle being pulled. The pulse motors 29 to 31 start to rotate and attain a constant speed after gradually increasing in speed. The pulse signals supplied to the motor control circuits 26 to 28 are counted by and thus stored in the micro computer 25. Since the counted number of pulse signals corresponds to the rotated position of the reel, the counter has to be reset every one revolution of the reel. For this reason, the reels 3 to 5 are provided with light-shielding members *3a*, *4a* and *5a*, respectively, which are detected by photo-interrupters 32 to 34 upon passing thereover. Signals from the photo-interrupters 32 to 34 are fed to the micro computer 25 to reset the previous content to zero. Since, during the constant rotation of the reels, the reset signals can be expected to be produced at regular intervals, the occurrence of desynchronization of the pulse motors 29 to 31 can be detected from irregularities in the intervals. The pulse motors 29 to 31 have to be restarted upon the detection of desynchronization of the pulse motors. This operation is previously programmed into the micro computer and automatically takes place.

After a constant speed has been attained, stop signals can be applied to the micro computer 25 upon pushing the stop switches 9 to 11 at random, causing the pulse motors 29 to 31 to stop individually in dependence on the disappearance of pulses to the motor control circuits 26 to 28 associated with the respective stop switches 9 to 11. For simplification of the machine in operation, the machine can be so modified that the pulse motors 29 to 31 are caused one after another to stop by pushing a single stop switch repeatedly. Such modification is performed only by programing the operation into the micro computer 25.

Upon pushing the stop switches 9 to 11 to stop the reels 3 to 5 individually, the micro computer 25 determines the occurrence patterns of combinations of symbols in given prize-awarding rows, and decides the number of prize coins to be paid out corresponding to the occurrence patterns of prize-winning combinations. The micro computer 25 further controls a coin pay-out device, for instance a hopper 36, to pay out a given number of coins 35 into the saucer 13, each of said coins being paid out actuating a micro-switch 37 to generate a pulse signal which is counted up to stop the coin pay-out device.

Figure 3:
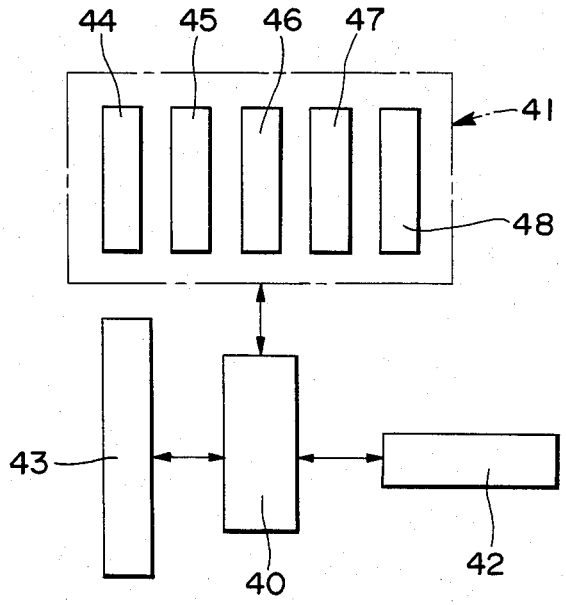
FIG. 3 is a block diagram showing a micro computer of the control circuit shown in FIG. 2.

FIG. 3 shows a schematic block diagram of the micro computer wherein a conventional microprocessor 40, a conventional ROM 41 including table memories 44 to 46 for storing information as to arrangements of symbols provided on the respective reels, a conventional memory 47 for storing information as to prize-winning combinations of symbols and prize-awarding rows and a conventional program memory 48, a RAM, and an interface 43. Since the respective table memories 44 to 46 have stored the information as to the symbols on the associated reels 3 to 5 according to the order of arrangement, code signals of symbols in the middle row can be read out by accessing the table memories with address signals of stopped positions of the reels. By accessing the table memories with address signals added or subtracted "1" (one) from the address signals of stopped position of the reels, the code signals of symbols above or below the symbols in the middle row can be determined. The operation is, in practice, as follows:

When the reels stop, individually, the table memories 44 to 46 are accessed one after another so as to read out code signals of three symbols, one for every reel, according to the stopped positions to the microprocessor 40. The microprocessor 40 then reads out predetermined prize-winning combinations of symbols one after another from the memory 47 to compare a respective one of symbols of the predetermined prize-winning combinations with all of the symbols that have actually occurred. Upon the detection of the coincidence of the actually occurring combination with any of the predetermined prize-winning combinations, the information as to the number of coins to be paid out stored in the memory 47 is read out to the microprocessor 40 in order to control the hopper 36 so as to pay out a given number of prize coins. In the block diagram shown in FIG. 3, the program memory 48 stores a game program, and the RAM 42 stores information as to the number of coins that have been inserted and as to the numbers of pulses fed to the respective pulse motors 29 to 31 for the rotation thereof.

What is claimed is:

1. A slot machine having a pluraltiy of reels provided each with an annular series of various symbols, said reels being rotatably arranged side-by-side, wherein, upon the occurrence of a predetermined prize winning combination of symbols in prize awarding rows of said symbols, coins or tokens are paid out, said slot machine comprising:

a pulse motor individual to each said reel;

means to supply a series of pulses to said motor continuously during the rotation of the reel associated with said motor, for driving said motor;

means for stopping each said reel;

means for detecting the stopped position of each said reel, said detecting means comprising means for counting said pulses as they are supplied to said pulse motor, a light shielding member on each reel, and a photo-interrupter responsive to interruption of light by said light shielding member for resetting the previous content of said counting means to zero once each rotation of the reel;

memory table means for storing information as to the symbol arrangements of the respective reels;

memory means for storing information as to the number of coins or tokens to be paid out according to predetermined prize winning combination of symbols;

means for paying out coins or tokens as prizes; and a microprocessor for accessing said memory table means with the contents of said counting means of the respective reels to read out particular combinations of symbols that have occurred in the prize awarding rows so as to detect coincidence of said particular combinations of symbols with said predetermined prize winning combinations of symbols and to control said pay-out means to pay out a given number of coins or tokens as prizes.

2. A slot machine as defined in claim 1, further including a start switch for causing said pulse motors to rotate, and stop switches associated with said pulse motors, respectively, for selectively individually stopping said pulse motors.

* * * * *